US009321144B2

(12) United States Patent
Woo et al.

(10) Patent No.: US 9,321,144 B2
(45) Date of Patent: Apr. 26, 2016

(54) POLISHING HEAD IN CHEMICAL MECHANICAL POLISHING APPARATUS AND CHEMICAL MECHANICAL POLISHING APPARATUS INCLUDING THE SAME

(71) Applicant: SAMSUNG ELECTRONICS CO., LTD., Suwon-si, Gyeonggi-do (KR)

(72) Inventors: Chang Gyu Woo, Anyang-si (KR); Sung Ho Shin, Yongin-si (KR); Joo Yeop Nam, Hwaseong-si (KR); Ki Hong Cho, Anyang-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 46 days.

(21) Appl. No.: 14/183,714

(22) Filed: Feb. 19, 2014

(65) Prior Publication Data

US 2014/0242886 A1 Aug. 28, 2014

(30) Foreign Application Priority Data

Feb. 25, 2013 (KR) ..... 10-2013-0019804

(51) Int. Cl.
*B24B 7/22* (2006.01)
*B24B 41/047* (2006.01)
*B24B 37/32* (2012.01)

(52) U.S. Cl.
CPC ..... *B24B 41/047* (2013.01); *B24B 37/32* (2013.01)

(58) Field of Classification Search
CPC ..... B24B 37/10; B24B 37/32; B24B 37/27; B24B 37/30; B24B 7/22
USPC ..... 451/288, 289, 290, 388, 398
See application file for complete search history.

(56) References Cited

U.S. PATENT DOCUMENTS

| | | | | |
|---|---|---|---|---|
| 6,361,419 | B1 | 3/2002 | Zuniga et al. | |
| 6,558,232 | B1 | 5/2003 | Kajiwara et al. | |
| 6,872,122 | B2 | 3/2005 | Zuniga | |
| 7,063,604 | B2 | 6/2006 | Spiegel | |
| 7,238,083 | B2 | 7/2007 | Fuhriman et al. | |
| 7,364,496 | B2 | 4/2008 | Berkstresser et al. | |
| 7,575,504 | B2 * | 8/2009 | Zuniga et al. | 451/288 |
| 8,100,743 | B2 * | 1/2012 | Nabeya et al. | 451/286 |
| 8,939,817 | B2 * | 1/2015 | Son | 451/398 |

(Continued)

FOREIGN PATENT DOCUMENTS

| | | | |
|---|---|---|---|
| JP | 2005-011999 | A | 1/2005 |
| KR | 10-2001-0002503 | A | 1/2001 |

(Continued)

*Primary Examiner* — Robert Rose
(74) *Attorney, Agent, or Firm* — Lee & Morse, P.C.

(57) ABSTRACT

A polishing head of a chemical mechanical polishing apparatus includes a housing moving up and down, a base assembly connected to a bottom of the housing to support the housing, a membrane on a bottom of the base assembly and a retainer ring surrounding the membrane and connected to the bottom of the base assembly, the membrane including a pressing portion to adsorb and press a substrate, a first partition on the pressing portion and extending from an edge of the pressing portion along a height direction, a first horizontal extending portion extending from an upper end portion of the first partition toward a center of the membrane, and a second horizontal extending portion from the upper end portion of the first partition toward the center of the membrane, the second horizontal extending portion being above the first horizontal extending portion and including a curved portion expanding by pneumatic pressure.

20 Claims, 7 Drawing Sheets

(56) References Cited

U.S. PATENT DOCUMENTS

| | | | | |
|---|---|---|---|---|
| 2002/0177395 | A1 | 11/2002 | Han et al. | |
| 2007/0010181 | A1 | 1/2007 | Spiegel | |
| 2007/0232193 | A1* | 10/2007 | Yasuda et al. | 451/5 |
| 2007/0293129 | A1* | 12/2007 | Togawa et al. | 451/67 |
| 2009/0023368 | A1 | 1/2009 | Wu et al. | |
| 2012/0164918 | A1 | 6/2012 | Lee et al. | |

FOREIGN PATENT DOCUMENTS

| | | | |
|---|---|---|---|
| KR | 2004/0074269 | A | 8/2004 |
| KR | 10-2004-0108489 | A | 12/2004 |
| KR | 10-2005-0056340 | A | 6/2005 |
| KR | 2006/0044770 | A | 5/2006 |
| KR | 10-1223010 | B1 | 1/2013 |

* cited by examiner

POLISHING HEAD IN CHEMICAL MECHANICAL POLISHING APPARATUS AND CHEMICAL MECHANICAL POLISHING APPARATUS INCLUDING THE SAME

CROSS-REFERENCE TO RELATED APPLICATION

Korean Patent Application No. 10-2013-0019804, filed on Feb. 25, 2013, in the Korean Intellectual Property Office, and entitled: "Polishing Head In Chemical Mechanical Polishing Apparatus and Chemical Mechanical Polishing Apparatus Including The Same," is incorporated by reference herein in its entirety.

BACKGROUND

1. Field

Embodiments relate to a polishing head in a chemical mechanical polishing apparatus and a chemical mechanical polishing apparatus including the same. More particularly, embodiments relate to a polishing head in a chemical mechanical polishing apparatus, which can polish a substrate evenly, and a chemical mechanical polishing apparatus including the same.

2. Description of the Related Art

In general, a wafer is manufactured into a semiconductor device, e.g., a chip may be manufactured by repetitively performing photolithography, ionic diffusion, etching, chemical vapor deposition, metal vapor deposition, or the like processes. A wafer, after undergoing the foregoing processes, may be further processed to form metal wiring thereon, e.g., to form a fine pattern.

With recent high integration, the structure of the semiconductor device has become multi-layered. That is, as higher integration is applied to the semiconductor device, a multi-layered wiring structure, where metal wiring, an insulation film, intermediate wiring, etc. constitute a plurality of layers, is formed on the wafer. Accordingly, the surface of the wafer needs to be planarized.

This is because if a fine pattern layer is sequentially formed on a wafer having another uneven fine pattern, a gap between the wafer having the unevenness and the mask placed on the wafer to form the fine pattern is not uniform. Therefore, a desired fine pattern would be out of focus of a projection lens and, thus, not precisely formed. Accordingly, the unevenness on the wafer is planarized to improve the precision of the fine pattern, e.g., by polishing the surface of the wafer.

For example, a chemical mechanical polishing (CMP) apparatus capable of both chemically and mechanically polishing the wafer may be used. The mechanical polishing refers to polishing of the surface of the wafer using friction between a polishing pad and the surface of the wafer by applying a predetermined load to the wafer and rotating the wafer in the state that the wafer is placed on the rotating polishing pad. The chemical polishing refers to polishing of the surface of the wafer using a chemical polishing agent, i.e., slurry supplied between the polishing pad and the wafer.

A conventional CMP apparatus may include a polishing station, on which the polishing pad is installed, and a polishing head positioned above the polishing station and pressing a wafer toward the polishing pad. Further, the polishing head is provided with a retainer ring surrounding a membrane in order to prevent the wafer and the membrane for pressing the wafer from being separated during the processes.

SUMMARY

Embodiments provide a polishing head of a chemical mechanical polishing apparatus, which can polish a substrate evenly.

Embodiments also provide a chemical mechanical polishing apparatus including a polishing head, which can polish a substrate evenly.

According to embodiments, there is provided a polishing head of a chemical mechanical polishing apparatus, including a housing configured to move up and down, a base assembly connected to a bottom of the housing, the base assembly being configured to support the housing, a membrane on a bottom of the base assembly, the membrane including a pressing portion configured to adsorb and press a substrate, a first partition on the pressing portion, the first partition extending from an edge of the pressing portion along a height direction, a first horizontal extending portion extending from an upper end portion of the first partition toward a center of the membrane, and a second horizontal extending portion extending from the upper end portion of the first partition toward the center of the membrane, the second horizontal extending portion being above the first horizontal extending portion and including a curved portion configured to expand by pneumatic pressure, and a retainer ring surrounding the membrane and connected to the bottom of the base assembly.

The polishing head may further include a first clamp in contact with and supporting an inner side of the first partition, a lower end portion of the first clamp perpendicularly contacting the pressing portion.

A lower end portion of the first partition may include a recessed groove adjacent to the pressing portion and facing a center of the membrane, the lower end portion of the first clamp including a protrusion inserted in the recessed groove and supporting the lower end portion of the first partition.

An outer lower end portion of the first partition adjacent to an edge portion of the pressing portion may be rounded.

The polishing head may further include a second clamp on an outer side of the first partition and opposite to the first clamp, the second clamp being inserted in the outer side of the first partition and supports the first partition.

The polishing head may further include a third clamp including a first end portion connected to the base assembly and a second end portion surrounding the curved portion of the second horizontal extending portion, the third clamp defining a limited expansion space for the curved portion.

The polishing head may further include a fourth clamp including a first end portion connected to the base assembly and a second end portion inserted between the first horizontal extending portion and the second horizontal extending portion, the fourth clamp supporting the second horizontal extending portion.

The membrane may further include a second partition in the pressing portion and spaced apart from the first partition toward a center of the pressing portion, the second partition extending from the pressing portion along the height direction, and a third horizontal extending portion extended from an upper end portion of the second partition toward the center of the membrane, the third horizontal extending portion being under the first horizontal extending portion.

The polishing head may further include a fifth clamp including a first end portion connected to the base assembly and a second end portion inserted between the first horizontal extending portion and the third horizontal extending portion, the fifth clamp supporting the first horizontal extending portion, and a sixth clamp including a first end portion connected to the base assembly and a second end portion inserted between the third horizontal extending portion and the pressing portion to support the third horizontal extending portion.

According to embodiments, there is also provided a chemical mechanical polishing apparatus, including a polishing station including a polishing pad for polishing a substrate, and a polishing head above the polishing station, the polishing head pressing the substrate toward the polishing pad and including a housing configured to move up and down, a base assembly connected to a bottom of the housing, the base assembly being configured to support the housing, a membrane on a bottom of the base assembly, the membrane including a pressing portion configured to adsorb and press a substrate, a first partition on the pressing portion, the first partition extending from an edge of the pressing portion along a height direction, a first horizontal extending portion extending from an upper end portion of the first partition toward a center of the membrane, and a second horizontal extending portion extending from the upper end portion of the first partition toward the center of the membrane, the second horizontal extending portion being above the first horizontal extending portion and including a curved portion configured to expand by pneumatic pressure, and a retainer ring surrounding the membrane and connected to the bottom of the base assembly.

The polishing head may further include a first clamp in contact with and supporting an inner side of the first partition, a lower end portion of the first clamp perpendicularly contacting the pressing portion.

The polishing head may further include a second clamp on an outer side of the first partition, disposed opposite to the first clamp, inserted in the outer side of the first partition, and supports the first partition.

The polishing head may further include a third clamp including a first end portion connected to the base assembly and a second end portion surrounding the curved portion, the third clamp defining a limited expansion space for the curved portion.

The polishing head may further include a fourth clamp including a first end portion connected to the base assembly and a second end portion inserted between the first horizontal extending portion and the second horizontal extending portion to support the second horizontal extending portion.

The membrane may further include a second partition in the pressing portion, spaced apart from the first partition toward a center of the pressing portion, and extended from the pressing portion in a height direction, and a third horizontal extending portion extended from an upper end portion of the second partition toward the center of the pressing portion, and disposed under the first horizontal extending portion, wherein the polishing head may further include a fifth clamp including a first end portion connected to the base assembly and a second end portion inserted between the first horizontal extending portion and the third horizontal extending portion to support the first horizontal extending portion, and a sixth clamp including a first end portion connected to the base assembly and a second end portion inserted between the third horizontal extending portion and the pressing portion to support the third horizontal extending portion.

According to embodiments, there is provided a polishing head of a chemical apparatus including a housing configured to move up and down, a base assembly connected to the housing, a membrane on a bottom of the base assembly, the membrane including a pressing portion spaced apart from the base assembly and configured to adsorb and press a substrate, a first partition extending from an edge of the pressing portion toward the base assembly, a first horizontal extending portion extending from an upper end portion of the first partition toward a center of the membrane, and a second horizontal extending portion extending from the upper end portion of the first partition toward the center of the membrane, the second horizontal extending portion being above and spaced apart from the first horizontal extending portion and including a curved portion configured to expand by pneumatic pressure, and a retainer ring surrounding the membrane and connected to the bottom of the base assembly.

The polishing head may further include a plurality of air channels through the base assembly and into the membrane, and a plurality of clamps in contact with the first and second horizontal extending portions, the clamps defining pressing chambers in the membrane.

The pressing chambers may include a first pressing chamber between the first and second horizontal extending portions, and second and third pressing chambers between the first horizontal extending portion and the pressing portion.

The polishing head may further include a third horizontal extending portion between the second and third pressing chambers.

The first partition may include horizontal portions extending from opposite edges, the horizontal portions extending away from the center of the membrane and defining a groove along a height of the first partition, a support clamp being positioned in the groove.

BRIEF DESCRIPTION OF THE DRAWINGS

Features will become apparent to those of ordinary skill in the art by describing in detail exemplary embodiments with reference to the attached drawings, in which.

DETAILED DESCRIPTION

Figure 1:
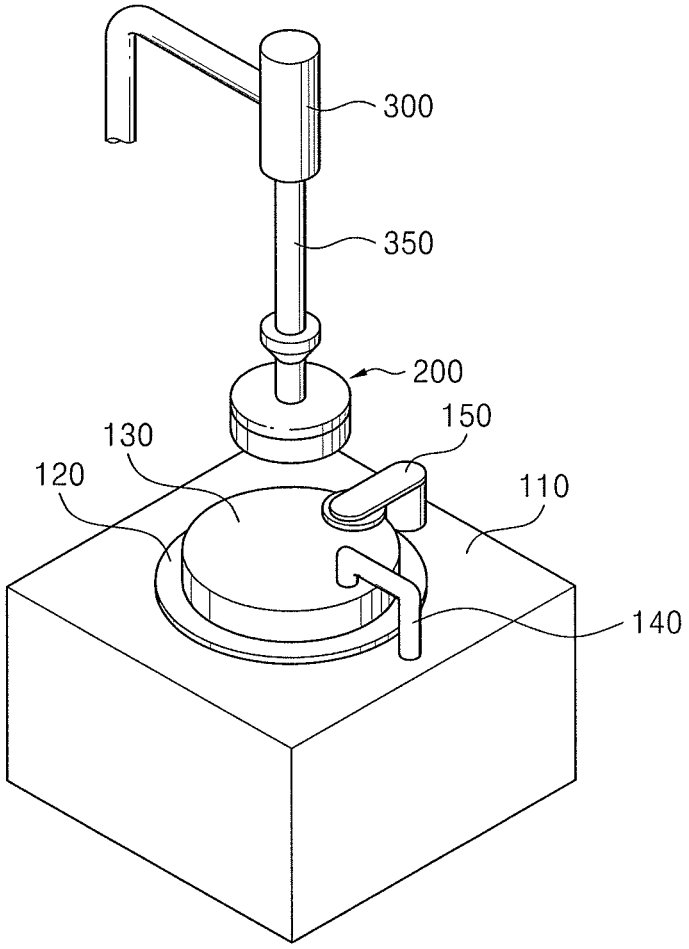
FIG. 1 illustrates a chemical mechanical polishing apparatus according to an embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

The attached drawings for illustrating embodiments are referred to in order to gain a sufficient understanding thereof. Like reference numerals in the drawings denote like elements.

Hereinafter, a substrate will be understood to include a semiconductor wafer, a panel substrate for a flat display panel, e.g., a liquid crystal display panel, a plasma display panel, etc., on which a plasma etching process is performed, and/or a substrate for an electronic device, e.g., a hard disk. A plasma etching device according to an embodiment will be described below.

Figure 2:
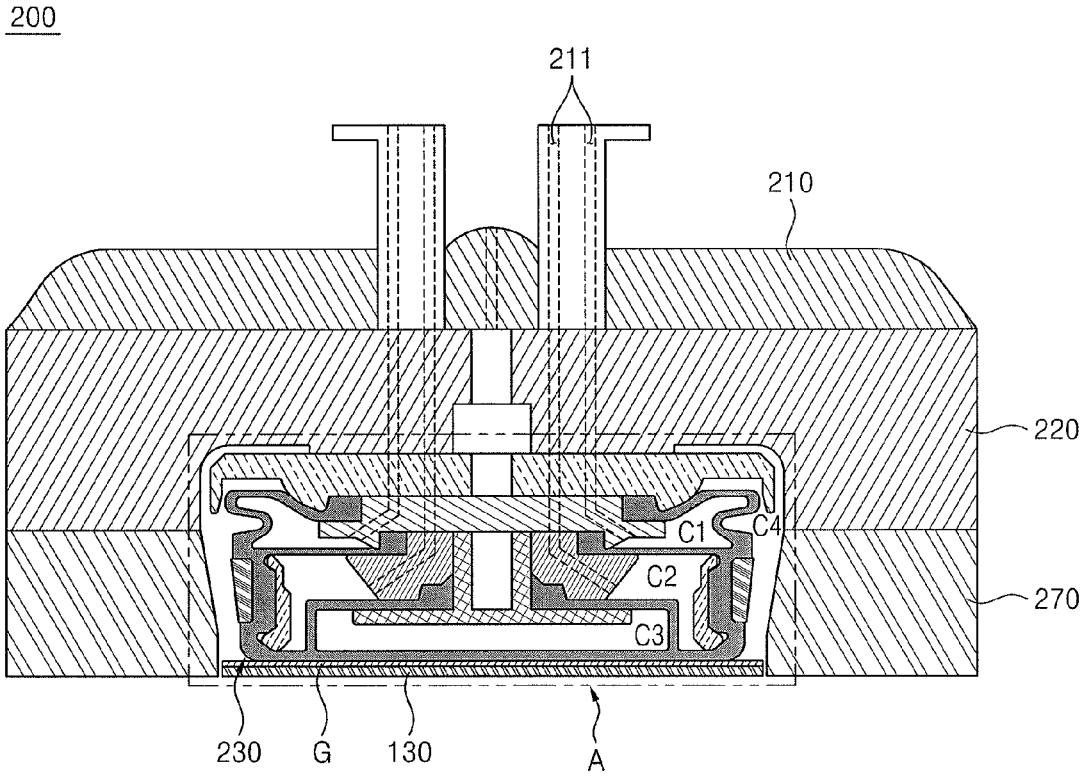
FIG. 2 illustrates a polishing head according to an embodiment.
Figure 3:
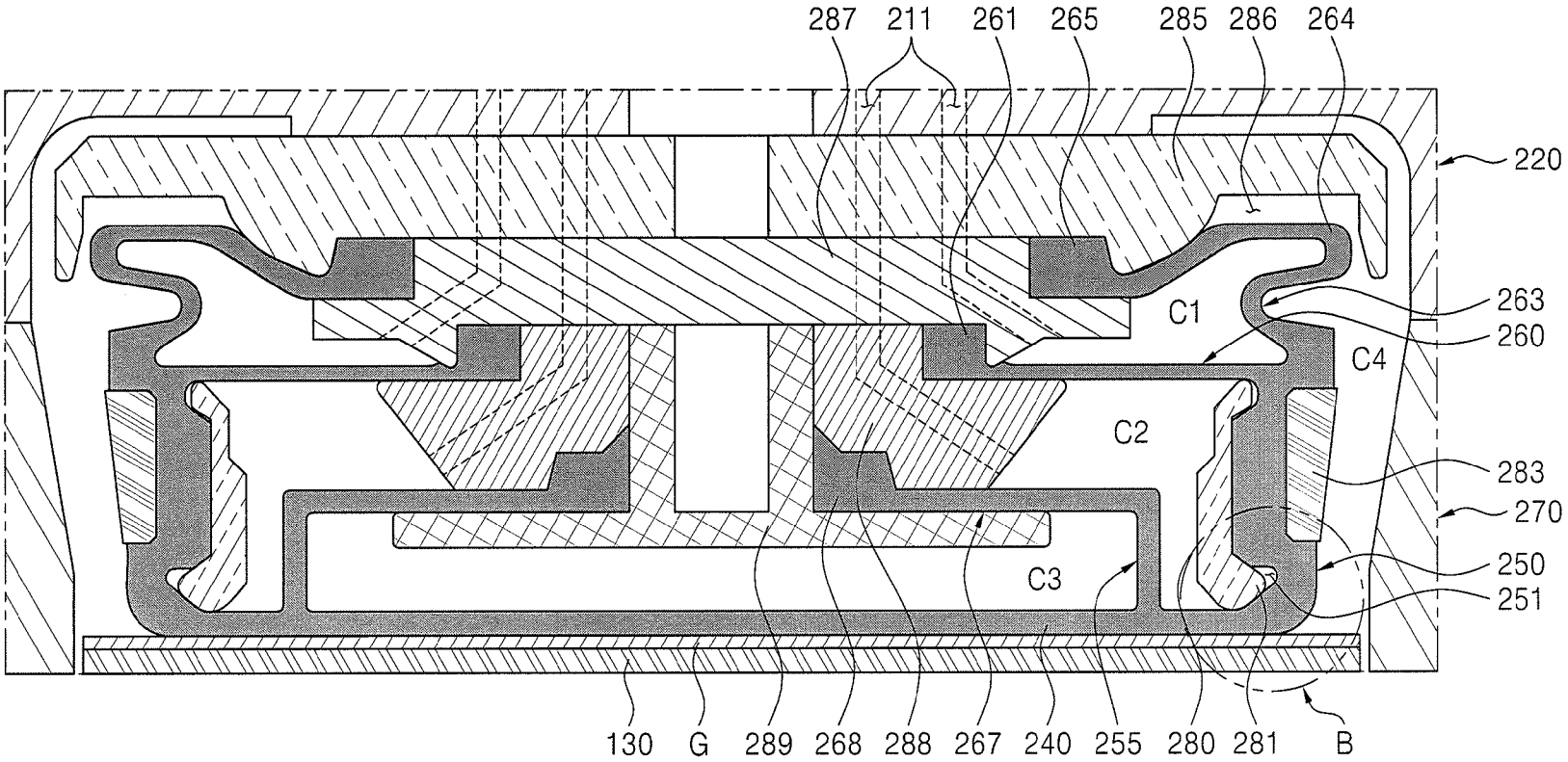
FIG. 3 illustrates an enlarged view of part 'A' in FIG. 2.
Figure 4:
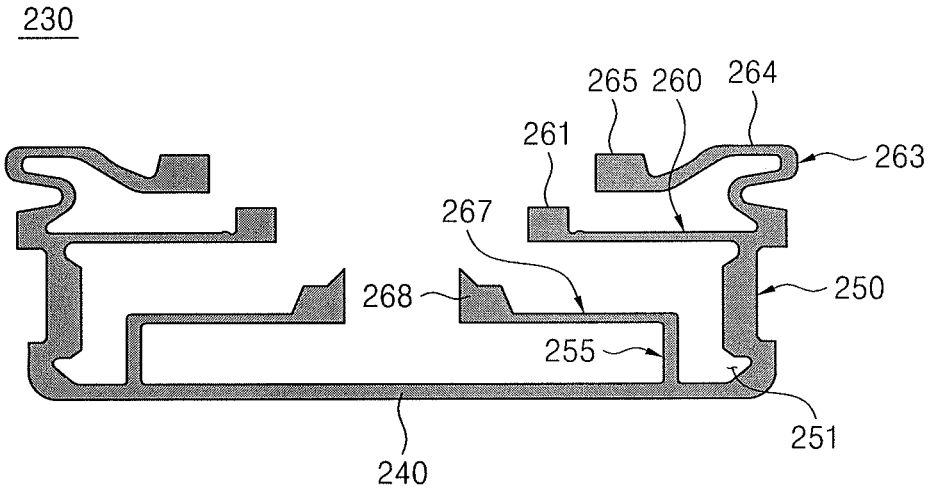
FIG. 4 illustrates a view showing a membrane according to an embodiment.
Figure 5A:
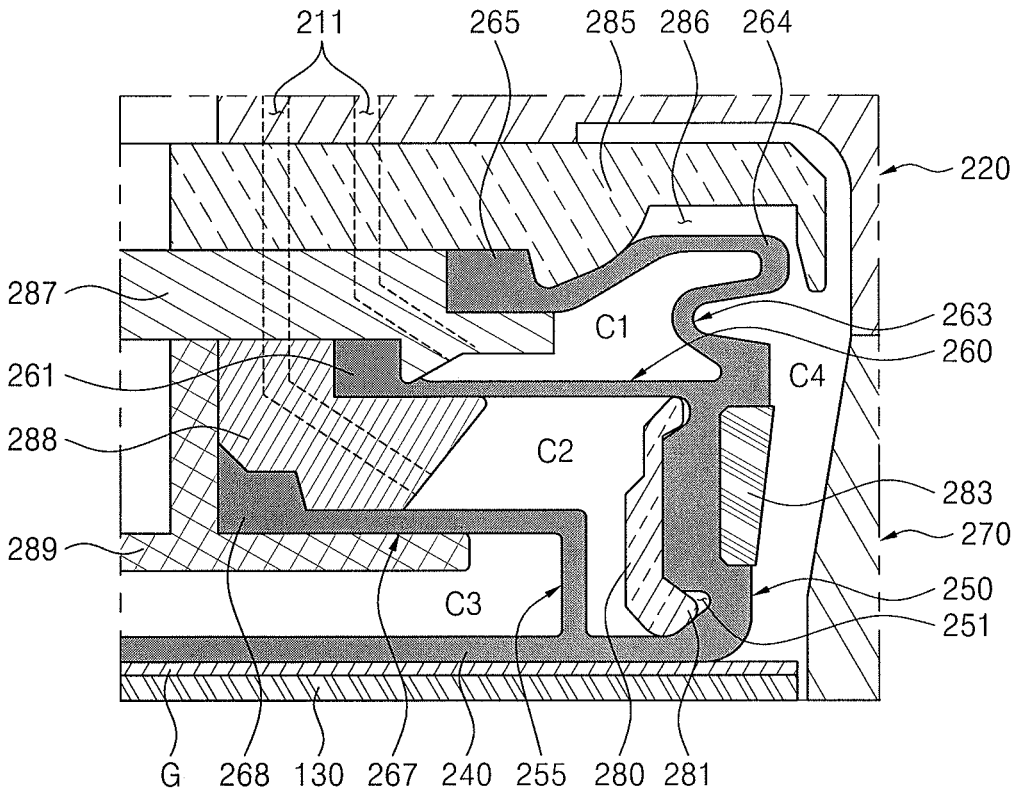
FIG. 5A illustrates a view showing a state before operating the membrane according to an embodiment.
Figure 5B:
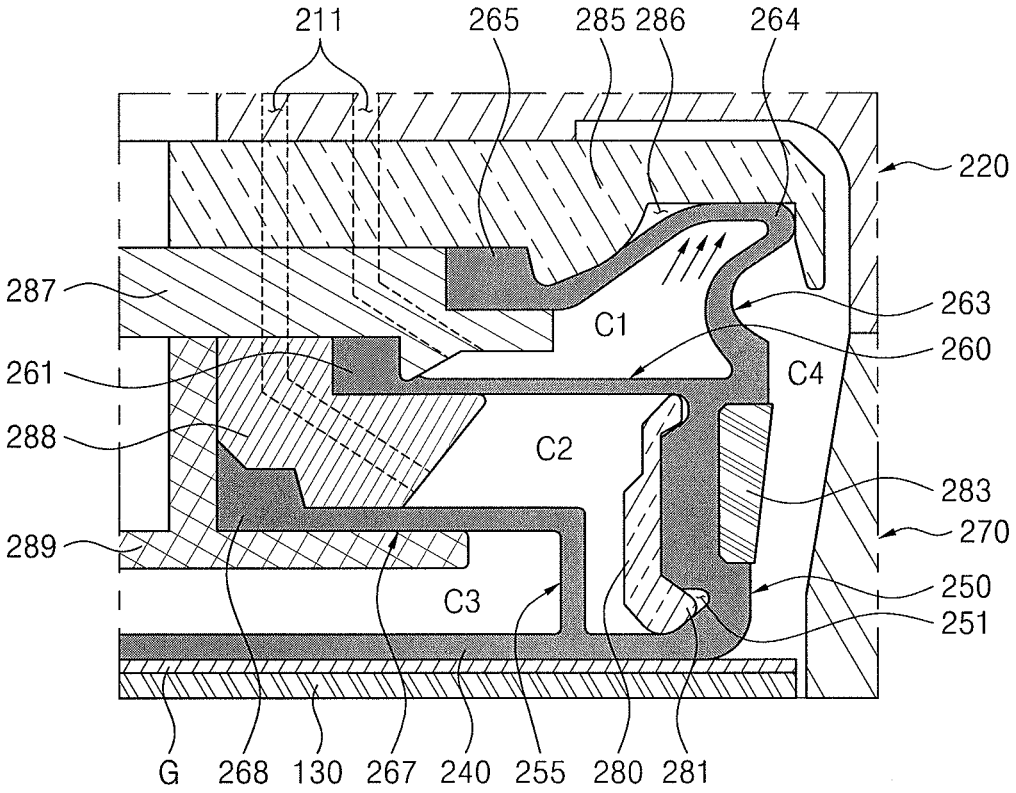
FIG. 5B illustrates a view showing a state after operating the membrane according to an embodiment.
Figure 6:
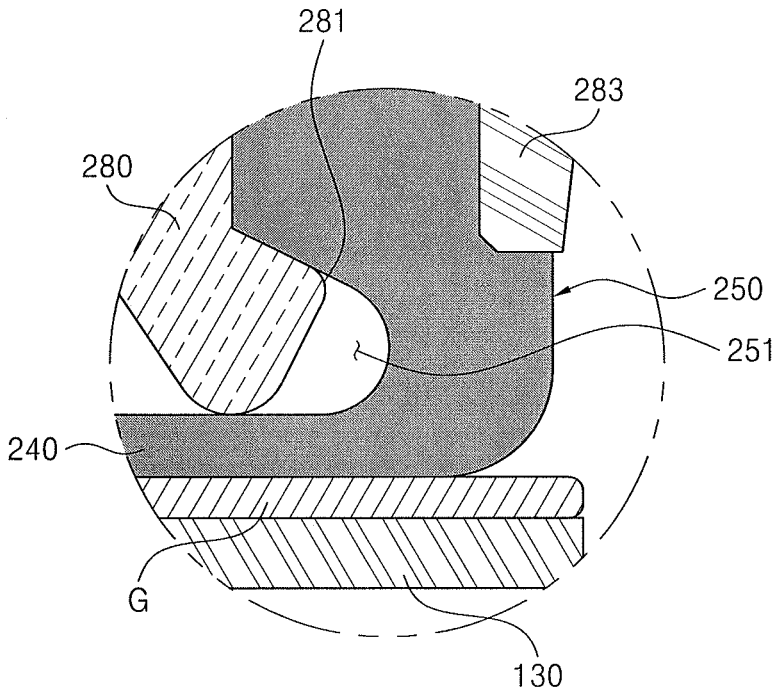
FIG. 6 illustrates an enlarged view of part 'B' in FIG. 3.

FIG. 1 illustrates a chemical mechanical polishing apparatus according to an embodiment, FIG. 2 illustrates a polishing head according to an embodiment, FIG. 3 illustrates an enlarged view of part 'A' in FIG. 2, FIG. 4 illustrates a view showing a membrane according to an embodiment, FIG. 5A illustrates a view showing a state before operating the membrane according to an embodiment, FIG. 5B illustrates a view showing a state after operating the membrane according to an embodiment, and FIG. 6 illustrates an enlarged view of part 'B' in FIG. 3.

Referring to FIG. 1, the chemical mechanical polishing apparatus according to an embodiment may include a polishing station 100 provided with a polishing pad 130 for polishing a substrate G (FIG. 2), and a polishing head 200 positioned above the polishing station 100 and pressing the substrate G toward the polishing pad 130.

The polishing station 100 may include a stage 110, where a polishing process is performed with regard to the substrate G, a platen 120 rotatably installed on the stage 110, the polishing pad 130 provided on the platen 120, a slurry supplying pipe 140 supplying slurry to the surface of the polishing pad 130, and a polishing pad adjuster 150 maintaining a polishing condition of the polishing pad 130.

The platen 120 is connected to a driving motor (not shown) provided inside the stage 110 and driven to rotate by the driving motor. Further, the substrate G may be stably seated on the polishing pad 130 placed on the platen 120, and the slurry may be supplied from the slurry supplying pipe 140 to the surface of the polishing pad 130 while the polishing process is performed with regard to the substrate G. Foreign materials or the like stained on the polishing pad 130 may be removed by the polishing pad adjuster 150 during the polishing process.

The polishing head 200 may be placed above the platen 120 and adsorbs the substrate G, thereby pressing the substrate G toward the polishing pad 130. For example, the polishing head 200 adsorbs the substrate G with vacuum, disposes it above the polishing pad 130, and pneumatically presses the substrate G toward the polishing pad 130.

The polishing head 200 may be connected to the driving motor 300 by means of a driving shaft 350, and rotates in a same direction as or an opposite direction to the rotating direction of the platen 120. The polishing head 200 pneumatically and uniformly presses the whole substrate G in order to evenly polish the substrate G. The polishing head 200 will be described in detail below with reference to FIGS. 2-3.

Referring to FIGS. 2 and 3, the polishing head 200 according to this embodiment may include a housing 210 connected to the driving shaft 350 and movable up and down, a base assembly 220 connected to the bottom of the housing 210 and supporting the housing 210, a membrane 230 provided on the bottom of the base assembly 220 and adsorbing and pressing the substrate G, a retainer ring 270 connected to the bottom of the base assembly 220 and surrounding the membrane 230, and a plurality of claims 280,283,285,287,288 and 289 (FIG. 3) connecting the membrane 230 to the base assembly 220.

The housing 210 may be formed to correspond to the shape of the substrate G to be polished. For example, the housing 210 may be formed to have a circular shape.

The housing 210 may move up and down in a direction perpendicular to the polishing pad 130, so that the contact between the substrate G and the polishing pad 130 may be established and disconnected in accordance with the movement of the housing 210. Further, the housing 210 may be connected to the driving motor 300, e.g., via the driving shaft 350, and may be rotated by the driving motor.

As further illustrated in FIG. 2, the housing 210 may be formed with a plurality of air channels 211 penetrating the housing 210 from the top to the bottom thereof. The plurality of air channels 211 form the channels through which compressed air flows in or out. The compressed air is transferred to the membrane 230 (to be described later) through the plurality of air channels 211, and contracts and expands so that the membrane 230 can press the substrate G toward the polishing pad 130 while adsorbing the substrate G.

As further illustrated in FIG. 2, the base assembly 220 may be connected to the bottom of the housing 210, and may support the housing 210. The housing 210 and the base assembly 220 may be movable up and down together in a direction perpendicular to the polishing pad 130. The base assembly 220 may have a same shape as the housing 210, e.g., the housing 210 and the base assembly 220 may have circular shapes.

Further, the base assembly 220 may include a level maintainer (not shown). The level maintainer controls the postures of the housing 210 and the base assembly 220 so that the polishing pad 130 and the substrate G can be parallel with each other.

As further illustrated in FIG. 2, the retainer ring 270 may be connected to the bottom of the base assembly 220 and may be disposed to surround the membrane 230 and the substrate G adsorbed to the membrane 230. For example, if the housing 210 and the base assembly 220 have circular shapes, the retainer ring 270 may also have a circular shape. The retainer ring 270 prevents the substrate G adsorbed to the membrane 230 from being separated from the polishing head 200 during the polishing process.

As further illustrated in FIG. 2, the membrane 230 may be provided on the bottom of the base assembly 220 in order to adsorb the substrate G and to press the substrate G toward the polishing pad 130. The membrane 230 is made of a resilient material, and thus elastically expands or contracts by the compressed air supplied through the plurality of air channels 211 provided in the housing 210.

During the polishing process of the substrate G, pressure applied to the substrate G is distributed so that the pressure applied to an edge portion of the substrate G may be relatively stronger than that applied to a center of the substrate G. Thus, in this embodiment, the shape of the membrane 230 is changed so as to apply uniform pressure throughout the substrate G by controlling the pressure concentrated at the edge portion of the substrate G.

In detail, referring to FIGS. 3 and 4, the membrane 230 in this embodiment includes a pressing portion 240 adsorbing and pressing the substrate G, a first partition 250 provided on the pressing portion 240 and extended from an edge portion of the pressing portion 240 in a height direction, a second partition 255 provided on the pressing portion 240 to be spaced apart from the first partition 250 toward a center of the pressing portion 240 and extended from the pressing portion 240 in a height direction, a first horizontal extending portion 260 extending from an upper end portion of the first partition 250 toward the center of the pressing portion 240, a second horizontal extending portion 263 extended from the upper end portion of the first partition 250 toward the center of the pressing portion 240 to be above the first horizontal extending portion 260 and provided with a curved portion 264, and a third horizontal extending portion 267 extended from an upper end portion of the second partition 255 toward the center of the pressing portion 240 and disposed under the first horizontal extending portion 260.

The pressing portion 240 is shaped to correspond to the shape of the substrate G, e.g., in plan view. For example, if the substrate G is shaped like a circular plate, the pressing portion 240 is also shaped like a circular plate. The bottom of the pressing portion 240 provides a mounting surface to which the substrate G is mounted. For example, the pressing portion 240 may be configured as a vacuum chuck for adsorbing the substrate G.

The first partition 250 is formed along the edge portion of the pressing portion 240. If the pressing portion 240 is shaped like a circular plate, the first partition 250 is shaped like a ring along the edge portion of the pressing portion 240.

The second partition 255 is spaced apart a predetermined distance from the first partition 250 toward the center of the pressing portion 240. That is, the second partition 255 and the first partition 250 are spaced apart a predetermined distance from each other and provided on the pressing portion 240 in a direction from the center of the pressing portion 240 to the edge portion.

Further, the first horizontal extending portion 260 and the second horizontal extending portion 263 are formed on the upper end portion of the first partition 250 and extended toward the center of the pressing portion 240. The second horizontal extending portion 263 is disposed above the first horizontal extending portion 260. Also, the third horizontal extending portion 267 is formed on the upper end portion of the second partition 255 and extended toward the center of the pressing portion 240. For example, as illustrated in FIG. 4, the first horizontal extending portion 260 may be between the second and third horizontal extending portions 264 and 267, and the first horizontal extending portion 260 may be substantially parallel to the third horizontal extending portion 267.

As illustrated in FIGS. 2-3, a plurality of pressing chambers C1, C2 and C3 may be formed inside the membrane 230 by the pressing portion 240, the first partition 250, the second partition 255, the first horizontal extending portion 260, the second horizontal extending portion 263, and the third horizontal extending portion 267. That is, a region between the first horizontal extending portion 260 and the second horizontal extending portion 263 forms, e.g., defines, a first pressing chamber C1, a region between the first horizontal extending portion 260 and the third horizontal extending portion 267 forms, e.g., defines, a second pressing chamber C2, and a region between the third horizontal extending portion 267 and the pressing portion 240 forms, e.g., defines, a third pressing chamber C3. Also, a region between the first partition 250 and the retainer ring 270 forms, e.g., defines, a fourth pressing chamber C4.

The first to third pressing chambers C1, C2, and C3 are in fluid communication with the plurality of air channels 211 of the housing 210. Therefore, the compressed air is supplied from the air channels 211 to fill the first to third pressing chambers C1, C2, and C3, thereby pushing against the pressing portion 240 and pressing the substrate G toward the polishing pad 130. The pneumatic pressure of the compressed air introduced into the first to third pressing chambers C1, C2, and C3 is controlled by a pneumatic pressure adjuster (not shown).

As further illustrated in FIGS. 3-4, at least one lower end portion of the first partition 250 and the second partition 255 may be formed with a recessed groove 251. FIG. 4 illustrates the recessed groove 251 opened from the lower end portion of the first partition 250 toward the center of the pressing portion 240, but it is not limited thereto. For example, the recessed groove 251 may be provided on the lower end portions of the first partition 250 and the second partition 255.

The recessed groove 251 allows the first partition 250 or the second partition 255 to be bent in a direction toward the lower pressure, if the pneumatic pressure applied to both sides of the first partition 250 or the second partition 255 is not balanced. In particular, if the pneumatic pressure applied to both sides of the first partition 250 or the second partition 255 is not balanced, the first partition 250 or the second partition 255 is bent in a direction toward the lower pressure, so that pressure can be balanced between both sides of the first partition 250 or the second partition 255, thereby correcting an imbalance of the pressure applied to the substrate G.

As illustrated in FIG. 3, the first partition 250 may be supported by a first clamp 280 and a second clamp 283. A lateral side of the first clamp 280 extends along and is in, e.g., direct, contact with an inner side of the first partition 250, e.g., the lateral side of the first clamp 280 supports the inner side of the first partition 250. Further, the first clamp 280 has an upper end portion contacting the first horizontal extending portion 260, and a lower end portion contacting the pressing portion 240. For example, the lower end of the first clamp 280 may face and push against a curved edge of the first partition 250, as illustrated in FIGS. 3 and 6.

In this embodiment, pressure concentrated at the edge portion of the substrate G is moved toward the center of the substrate G in order to decrease the pressure applied to the edge portion of the substrate G. That is, referring to FIG. 6, in order to move the pressure concentrated at the edge portion of the substrate G toward the center of the substrate G, an outer lower end portion of the first partition 250 is rounded to have a predetermined curvature. The outer lower end portion of the first partition 250 is rounded so that the edge portion of the pressing portion 240 contacting the substrate G can move toward the center of the substrate G. Thus, a position, to which the pneumatic pressure of the compressed air supplied to the first pressing chamber C1 is transferred, is moved toward the center of the substrate G.

Also, the lower end portion of the first clamp 280 is spaced apart from the first partition 250 toward the center of the pressing portion 240, e.g., via the recessed groove 251. Further, the lower end portion of the first clamp 280 perpendicularly contacts the pressing portion 240. Thus, the pressure concentrated at the edge portion of the substrate G is moved toward the center of the substrate G by the pneumatic pressure of the compressed air supplied to the first pressing chamber C1.

Further, as shown in FIG. 6, the lower end portion of the first clamp 280 may include a protrusion 281 to be inserted in the recessed groove 251 formed in the lower end portion of the first partition 250. The protrusion 281 may be inserted in the recessed groove 251 to support the lower end portion of the first partition 250. For example, as illustrated in FIGS. 3 and 6, while the protrusion 281 may be inserted into the recessed groove 251, a corner portion of the recessed groove 251 may remain empty.

As described above, in this embodiment, the lower end portion of the first clamp 280 is spaced apart from the first partition 250 toward the center of the pressing portion 240, and the outer lower end portion of the first partition 250 is rounded. Therefore, pressure concentrated at the edge portion of the substrate G may be moved toward the center of the substrate G.

The second clamp 283 may be provided on the outer side of the first partition 250 and may be disposed opposite to the first clamp 280, thereby supporting the outer surface of the first partition 250. The second clamp 283 may be inserted in the outer side of the first partition 250 to support the first partition 250, thereby preventing the outer lower end portion of the first partition 250 from contacting the edge portion of the substrate G and pressing the edge portion of the substrate G. Further, if the outer lower end portion of the first partition 250 is inclined to be positioned inside a virtual line vertically extended from the upper end portion, the outer side of the second clamp 283 is inclined corresponding to the outer side of the first partition 250.

When the polishing process is repeated multiple times with regard to the substrate G, the retainer ring 270 surrounding the membrane 230 may be gradually worn out, thereby causing reduced pneumatic pressure to be applied to the edge portion of the substrate G under the first partition 250 via the first pressing chamber C1. Accordingly, a wear rate at the edge portion of the substrate G may be lowered. However, according to exemplary embodiments, lowering of the wear rate at the edge portion of the substrate G may be prevented or substantially minimized by the second horizontal extending portion 263, which includes a curved portion 264, and by the polishing head 200, which includes a third clamp 285 to limit the expansion of the curved portion 264. In detail, the curved portion 264 expands upward when the compressed air is supplied, and the third clamp 285 is provided with a recessed accommodating portion 286 to accommodate the expanded curved portion 264, as will discussed in detail with reference to FIGS. 5A-5B.

FIG. 5A illustrates the second horizontal extending portion 263 before the retainer ring 270 is worn, in which the lower end portion of the first partition 250 presses the edge portion of the substrate G by the pneumatic pressure of the compressed air supplied to the first pressing chamber C1.

However, if the retainer ring 270 is worn as the polishing process is repeated for the substrate G, the pressure for allowing the lower end portion of the first partition 250 to press the edge portion of the substrate G is lowered, thereby supplying, e.g., maintaining, more compressed air to the first pressing chamber C1. Accordingly, the curved portion 264 of the second horizontal extending portion 263 expands upward, and the pneumatic pressure of the compressed air supplied to the first pressing chamber C1 is transferred to the lower end portion of the first partition 250.

As shown in FIG. 5B, if the curved portion 264 excessively expands upward, the efficiency of transferring the pneumatic pressure to the first partition 250 may be lowered. Therefore, the third clamp 285 for limiting the expansion of the curved portion 264 is provided above the upper portion of the curved portion 264. The expansion of the expanded curved portion 264 is limited by the accommodating portion 286 of the third clamp 285, thereby improving the efficiency of transferring the pneumatic pressure of the first pressing chamber C1 to the first partition 250.

As described above, in order to prevent the pneumatic pressure applied to the edge portion of the substrate G from decreasing due to the wear of the retainer ring 270, the second horizontal extending portion 263 is provided with the curved portion 264, which expands by the compressed air. In order to increase the efficiency of transferring the pneumatic pressure, e.g., in order to optimize the pneumatic pressure applied to the lower end portion of the first partition 250, the third clamp 285 is provided above the curved portion 264. In other words, the third clamp 285 limits the expansion of the curved portion 264, while accommodating the expanded curved portion 264, so the compressed air from the air channel 211 may be diverted in a downward direction, i.e., toward the lower end portion of the first partition 250, as expansion in an upward direction is limited by the third clamp 285.

Also, as illustrated in FIG. 2, the polishing head 200 may further include a fourth clamp 287 for supporting the bottom of the second horizontal extending portion 263. The fourth clamp 287 may have a first end portion connected to the base assembly 220, and a second end portion inserted between the first horizontal extending portion 260 and the second horizontal extending portion 263 to support the bottom of the second horizontal extending portion 263.

When the curved portion 264 of the second horizontal extending portion 263 expands by the pneumatic pressure of the compressed air supplied to the first pressing chamber C1, the second horizontal extending portion 263 is pushed in a horizontal direction, e.g., toward a center of the polishing head 200. However, the fourth clamp 287 presses and supports the end portion of the second horizontal extending portion 263 against the base assembly 220, thereby limiting a potential horizontal movement of the second horizontal extending portion 263.

As further illustrated in FIG. 3, an end portion of the second horizontal extending portion 263 may be formed with a second projection 265. The second projection 265 may be clamped by the third clamp 285, so a potential horizontal movement of the second horizontal extending portion 263 may be further limited.

As further illustrated in FIG. 3, the polishing head 200 may further include a fifth clamp 288 for supporting the bottom of the first horizontal extending portion 260, and a sixth clamp 289 for supporting the bottom of the third horizontal extending portion 267. The fifth clamp 288 may have a first end portion connected to the base assembly 220 and a second end portion inserted between the first horizontal extending portion 260 and the third horizontal extending portion 267, thereby supporting the bottom of the first horizontal extending portion 260.

If there is a difference in an internal pressure between the first pressing chamber C1 and the second pressing chamber C2, the first horizontal extending portion 260 is pushed in a direction toward the lower internal pressure among the first and second pressing chambers C1 and C2, and moves in a horizontal direction. In this case, the pneumatic pressure applied to the substrate G may be decreased.

Accordingly, the fifth clamp 288 is disposed longitudinally to be in contact with the bottom of the first horizontal extending portion 260, and the first horizontal extending portion 260 is pressed and supported by the fourth clamp 287, thereby limiting the expansion and the horizontal movement of the first horizontal extending portion 260. Also, the end portion of the first horizontal extending portion 260 may be formed with a first projection 261 clamped by the fourth clamp 287, thereby limiting further the horizontal movement of the first horizontal extending portion 260.

Further, the sixth clamp 289 has a first end portion connected to the base assembly 220, and a second end portion inserted between the third horizontal extending portion 267 and the pressing portion 240, thereby supporting the bottom of the third horizontal extending portion 267.

If there is a difference in an internal pressure between the second pressing chamber C2 and the third pressing chamber C3, the third horizontal extending portion 267 is pushed in a direction toward a lower internal pressure among the second and third pressing chambers C2 and C3, and moves in a horizontal direction. In this case, the pneumatic pressure applied to the substrate G may be decreased.

Accordingly, the sixth clamp 289 is disposed longitudinally to be in contact with the bottom of the third horizontal extending portion 267, and the third horizontal extending portion 267 is pressed and supported by the fifth clamp 288, thereby limiting the expansion and the horizontal movement of the third horizontal extending portion 267. Also, the end portion of the third horizontal extending portion 267 may be formed with a third projection 268 clamped by the fifth clamp 288, thereby further limiting the horizontal movement of the third horizontal extending portion 267.

The chemical mechanical polishing apparatus with the foregoing structure according to an embodiment operates as follows.

Referring to FIGS. 1 and 2, the substrate G, e.g., completely treated by a previous process, is adsorbed by the pressing portion 240 of the membrane 230, and then stably seated on to the top of the polishing pad 130 on the platen 120.

Further, the compressed air is supplied to the first to third pressing chambers C1, C2 and C3 through the plurality of air channels 211 provided in the housing 210 of the polishing head 200, and the pressing portion 240 uses the pneumatic pressure based on the compressed air supplied by the first to third pressing chambers C1, C2 and C3 to press the substrate G. At this time, the substrate G has to be uniformly pressed in order to polish the substrate G evenly.

At the same time, slurry is supplied to a position where the polishing pad 130 and the substrate G are in contact with each other. Thus, the substrate G is polished by both mechanical polishing via rotations of the platen 120 and the polishing head 200 connected to the driving shaft 350 and chemical polishing via the slurry. According to embodiments, the membrane is used to apply uniform pressure to the whole substrate, thereby polishing the whole substrate evenly.

In contrast, a conventional membrane of a polishing head may include a circular pressing plate having a lateral wall at its edge and a partition wall at its center for limiting a region to which vacuum is applied. However, since the conventional membrane is divided into only a vacuum region and a pressure region, it may be difficult to apply uniform pressure throughout the wafer when the polishing process is repeated. Accordingly, a problem arises in that the thickness of the polished wafer is not uniform while the wafer is polished.

Example embodiments have been disclosed herein, and although specific terms are employed, they are used and are to be interpreted in a generic and descriptive sense only and not for purpose of limitation. Accordingly, it will be understood by those of skill in the art that various changes in form and details may be made without departing from the spirit and scope of the present invention as set forth in the following claims.

What is claimed is:

1. A polishing head of a chemical mechanical polishing apparatus, comprising:

a housing configured to move up and down;

a base assembly connected to a bottom of the housing, the base assembly being configured to support the housing;

a membrane on a bottom of the base assembly; and a retainer ring surrounding the membrane and connected to the bottom of the base assembly, the membrane including:

a pressing portion configured to adsorb and press a substrate, a first partition on the pressing portion, the first partition extending from an edge of the pressing portion along a height direction, a first horizontal extending portion extending from an upper end portion of the first partition toward a center of the membrane, and a second horizontal extending portion extending from the upper end portion of the first partition toward the center of the membrane, the second horizontal extending portion being above the first horizontal extending portion and including a pressure-expandable curved portion, the curved portion including at least two folds covering each other above the first horizontal extending portion and being surrounded by an empty space on topmost and lateral sides thereof.

2. The polishing head as claimed in claim 1, further comprising a first clamp in contact with and supporting an inner side of the first partition, an upper end portion of the first clamp contacting a lower surface of the second horizontal extending portion and extending continuously downwardly to have a lower end portion of the first clamp perpendicularly contacting the pressing portion.

3. The polishing head as claimed in claim 2, wherein a lower end portion of the first partition includes a recessed groove adjacent to the pressing portion and facing a center of the membrane, the lower end portion of the first clamp including a protrusion inserted in the recessed groove and supporting the lower end portion of the first partition.

4. The polishing head as claimed in claim 3, wherein an outer lower end portion of the first partition adjacent to an edge portion of the pressing portion is rounded.

5. The polishing head as claimed in claim 2, further comprising a second clamp on an outer side of the first partition and opposite to the first clamp, the second clamp being inserted in the outer side of the first partition and supports the first partition.

6. The polishing head as claimed in claim 1, further comprising a third clamp including a first end portion connected to the base assembly and a second end portion defining the empty space surrounding the curved portion of the second horizontal extending portion, wherein:

the second end portion of the third clamp including at least two parts that are perpendicular to each other and surrounding the curved portion, the two perpendicular parts of the second end portion of the third clamp are connected to each other and are defining the empty space surrounding the curved portion, and the curved portion fills the empty space and contacts the third clamp upon expansion.

7. The polishing head as claimed in claim 1, further comprising a fourth clamp including a first end portion connected to the base assembly and a second end portion inserted between the first horizontal extending portion and the second horizontal extending portion, the fourth clamp supporting the second horizontal extending portion.

8. The polishing head as claimed in claim 1, wherein the membrane further includes:

a second partition in the pressing portion and spaced apart from the first partition toward a center of the pressing portion, the second partition extending from the pressing portion along the height direction; and a third horizontal extending portion extended from an upper end portion of the second partition toward the center of the membrane, the third horizontal extending portion being under the first horizontal extending portion.

9. The polishing head as claimed in claim 8, further comprising:

a fifth clamp including a first end portion connected to the base assembly and a second end portion inserted between the first horizontal extending portion and the third horizontal extending portion, the fifth clamp supporting the first horizontal extending portion; and a sixth clamp including a first end portion connected to the base assembly and a second end portion inserted between the third horizontal extending portion and the pressing portion to support the third horizontal extending portion.

10. A chemical mechanical polishing apparatus, comprising:

a polishing station including a polishing pad for polishing a substrate; and a polishing head above the polishing station, the polishing head pressing the substrate toward the polishing pad, the polishing head including:

a housing configured to move up and down, a base assembly connected to a bottom of the housing, the base assembly being configured to support the housing, a membrane on a bottom of the base assembly, and a retainer ring surrounding the membrane and connected to the bottom of the base assembly, the membrane including:

a pressing portion configured to adsorb and press a substrate, a first partition on the pressing portion, the first partition extending from an edge of the pressing portion along a height direction, a first horizontal extending portion extending from an upper end portion of the first partition toward a center of the membrane, and a second horizontal extending portion extending from the upper end portion of the first partition toward the center of the membrane, the second horizontal extending portion being above the first horizontal extending portion and including a pressure-expandable curved portion, the curved portion including at least two folds covering each other above the first horizontal extending portion and being surrounded by an empty space on topmost and lateral sides thereof.

11. The chemical mechanical polishing apparatus as claimed in claim 10, wherein the polishing head further comprises a first clamp in contact with and supporting an inner side of the first partition, a lower end portion of the first clamp perpendicularly contacting the pressing portion.

12. The chemical mechanical polishing apparatus according as claimed in claim 11, wherein the polishing head further comprises a second clamp on an outer side of the first partition, disposed opposite to the first clamp, inserted in the outer side of the first partition, and supports the first partition.

13. The chemical mechanical polishing apparatus as claimed in claim 10, wherein the polishing head further comprises a third clamp including a first end portion connected to the base assembly and a second end portion surrounding the curved portion, the third clamp defining a limited expansion space for the curved portion.

14. The chemical mechanical polishing apparatus as claimed in claim 10, wherein the polishing head further comprises a fourth clamp including a first end portion connected to the base assembly and a second end portion inserted between the first horizontal extending portion and the second horizontal extending portion to support the second horizontal extending portion.

15. The chemical mechanical polishing apparatus as claimed in claim 10, wherein the membrane further comprises:

a second partition in the pressing portion, spaced apart from the first partition toward a center of the pressing portion, and extended from the pressing portion in a height direction; and a third horizontal extending portion extended from an upper end portion of the second partition toward the center of the pressing portion, and disposed under the first horizontal extending portion, wherein the polishing head further comprises:

a fifth clamp including a first end portion connected to the base assembly and a second end portion inserted between the first horizontal extending portion and the third horizontal extending portion to support the first horizontal extending portion, and a sixth clamp including a first end portion connected to the base assembly and a second end portion inserted between the third horizontal extending portion and the pressing portion to support the third horizontal extending portion.

16. A polishing head of a chemical mechanical polishing apparatus, comprising:

a housing configured to move up and down;

a base assembly connected to the housing;

a membrane on a bottom of the base assembly; and a retainer ring surrounding the membrane and connected to the bottom of the base assembly, the membrane including:

a pressing portion spaced apart from the base assembly and configured to adsorb and press a substrate, a first partition extending from an edge of the pressing portion toward the base assembly, a first horizontal extending portion extending from an upper end portion of the first partition toward a center of the membrane, and a second horizontal extending portion extending from the upper end portion of the first partition toward the center of the membrane, the second horizontal extending portion being above the first horizontal extending portion and including a pressure-expandable curved portion, the curved portion including at least two folds covering each other above the first horizontal extending portion and being surrounded by an empty space on topmost and lateral sides thereof.

17. The polishing head as claimed in claim 16, further comprising:

a plurality of air channels through the base assembly and into the membrane; and a plurality of clamps in contact with the first and second horizontal extending portions, the clamps defining pressing chambers in the membrane.

18. The polishing head as claimed in claim 17, wherein the pressing chambers include a first pressing chamber between the first and second horizontal extending portions, and second and third pressing chambers between the first horizontal extending portion and the pressing portion.

19. The polishing head as claimed in claim 18, further comprising a third horizontal extending portion between the second and third pressing chambers.

20. The polishing head as claimed in claim 18, wherein the first partition includes horizontal portions extending from opposite edges, the horizontal portions extending away from the center of the membrane and defining a groove along a height of the first partition, a support clamp being positioned in the groove.

* * * * *